United States Patent [19]

Roger

[11] 3,942,223

[45] Mar. 9, 1976

[54] STAPLE DRAFT DEVICES

[75] Inventor: Gauvain Roger, Buhl, France

[73] Assignee: Societe Alsacienne de Constructions Mecaniques de Mulhouse, Mulhouse, France

[22] Filed: Mar. 11, 1974

[21] Appl. No.: 450,151

[30] Foreign Application Priority Data

Mar. 13, 1973 France ..... 73.08809

[52] U.S. Cl. ..... 19/258; 19/295

[51] Int. Cl.[2] ..... D01H 5/24

[58] Field of Search ..... 19/258, 236, 260, 261, 19/293, 295

[56] References Cited

UNITED STATES PATENTS

| | | | |
|---|---|---|---|
| 460,083 | 9/1891 | Dunham et al. | 19/260 |
| 2,219,666 | 10/1940 | Solanas | 19/236 |
| 2,644,988 | 7/1953 | Haythornthwaite et al. | 19/261 |
| 3,417,436 | 12/1968 | Masurel | 19/258 |

FOREIGN PATENTS OR APPLICATIONS

| | | | |
|---|---|---|---|
| 264,574 | 1/1927 | United Kingdom | 19/258 |
| 94,895 | 11/1897 | Germany | 19/236 |

*Primary Examiner*—Dorsey Newton
*Attorney, Agent, or Firm*—Holman & Stern

[57] ABSTRACT

This invention relates to a staple draft device comprising a pair of feed rollers and a pair of drawing-off rollers, said pairs determining therebetween the course of a staple lap to be drawn off, there being at one side of said course a feed roller with needle-like projections and a control roller also with such projections, and at the other side of said course a supplementary needled-surface roller which co-operates solely with said needled-surface feed roller, and a single levelling-down roller which is smooth, co-operates solely with said needled-surface control roller, and is preferably positively driven at an angular speed such that the peripheral speeds of said levelling-down and control rollers with needle-like projections are equal.

3 Claims, 3 Drawing Figures

1
2
3
4
5
8
9
10
12
13
E
e
e'
II
II

STAPLE DRAFT DEVICES

FIELD OF THE INVENTION

This invention relates to staple draft devices of the type comprising, between a pair of feed rollers and a pair of drawing-off rollers, a needled-surface feed roller and a needled-surface control roller located at one side of the course of the staple lap to be drawn off, as well as at least one levelling-down or compacting roller located at the other side of said course.

BACKGROUND OF THE INVENTION

In the specification of French Patent No. 1,449,615 of Jan. 12, 1965, there is described such a staple draft device which includes two levelling-down or compacting rollers one of which co-operates with both the needled-surface feed control rollers; while the other co-operates solely with the feed roller at a location situated a little more upstream in relation to the direction of forward movement of the staple while being drawn off.

Now, such devices have disadvantages. Indeed, it has been established that on account of the relatively great thickness or depth of the staple laps which are nowadays worked on this type of machine, the needled-surface feed roller meets with difficulties in controlling the staple mass as the latter passes with some difficulty between the fallers of this roller, so that the upper stratum of staple is no longer controlled by the needles and is drawn-off irregularly or else not at all. If an attempt is made to force the staple lap completely down between the needles of the roller, it is found that the lower layers of staple are jammed between the bottoms of the needles and that drawing off of the fibres of the staple relative to one another no longer takes place. In order that the drawing-off might be carried out in a normal manner, it is necessary that the staple to be drawn be controlled in a set of needles in such manner that the fibres are able to slip relative to one another.

SUMMARY OF THE INVENTION

The object of the invention is to provide a staple draft device of the type under consideration and which does not have the disadvantages of the device referred to hereinbefore.

According to the present invention, we provide a staple draft device comprising a pair of feed rollers and a pair of drawing-off rollers, said pairs determining therebetween the course of a staple lap to be drawn off, there being at one side of said course a serrated feed roller and a needled-surface control roller and at the other side of said course a supplementary needled-surface roller which forms a nip solely with said needled-surface feed roller, and a single levelling-down roller which is smooth and forms a nip solely with the needled-surface control roller.

Thanks to this particular construction, the staple lap is controlled throughout its thickness because it passes between two sets of needles which penetrate into said lap at both faces of the latter, respectively. Thus, the fibres can slip each relative to the other and drawing off takes place in the normal manner.

Moreover, in the drawing-off device which is the subject of the aforesaid patent, one of the levelling-down or compacting rollers co-operates both with the needled-surface feed and control rollers. Now, given that the peripheral speeds of these two needled-surface rollers are not equal, the speed of the levelling-down or compacting roller which presses the staple on these two rollers and which is rotated by said staple, is defined in an imprecise manner. It is nevertheless desirable that the levelling-down or compacting roller turn at the same linear speed as that of the control roller with the needled-surface. This condition is carried into effect in the device according to the invention where the single levelling-down or compacting roller forms a nip solely with the needled-surface control roller and is driven only by the staple in contact with the needles of the latter roller. Moreover, in the device of the aforesaid patent, this same levelling-down or compacting roller which had to form nips simultaneously with the two needled-surface rollers occupied, in relation to the needled-surface control roller, a fixed position which did not consequently allow regulation of the depth to which the staple lap was forced down into the set of needles of the serrated control roller. Now, it is altogether desirable for this forcing down to be regulatable in terms of the nature of the materials of which the staple to be drawn off is constituted, between values of the order of 0.5 to 10 mm. Given that the levelling-down or compacting roller no longer has to form a nip with the needled-surface feed roller, it is possible, according to another feature of the invention, to regulate the distance of its axis from that of the needled-surface control roller and, consequently, the depth to which the staple is forced down by said roller into the set of needles of the control roller.

The invention will be better understood on reading the following description and examining the accompanying drawings which show, by way of example, one embodiment of a staple draft device according to the invention, and in which:

DESCRIPTION OF A PREFERRED EMBODIMENT

Figure 1:
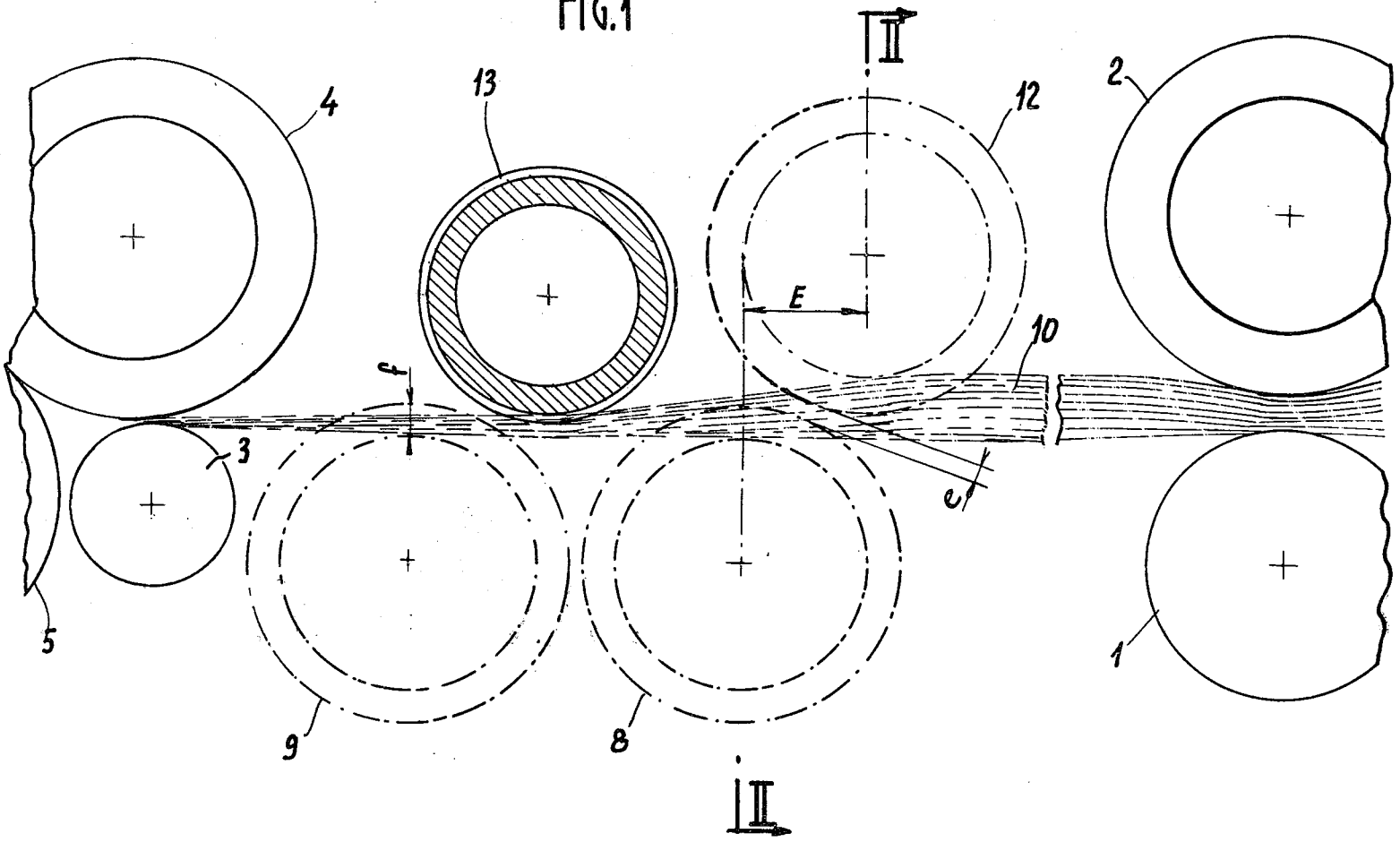
FIG. 1 is a sectional view showing the arrangement of the various component units or members of the staple draft device.

The staple draft device shown in FIG. 1 includes a pair of feed and retention rollers 1, 2 and a pair of drawing-off rollers 3, 4 with which is associated another lower delivery or discharge roller 5 in such a manner that the upper drawing-off roller 4 rests, at one and the same time, on the two lower rollers 3 and 5. The lower rollers 1, 3 and 5 are fluted rollers while the upper pressure rollers 2 and 4 are furnished with flexible cylindrical coverings of suitable plastics material. The lower rollers 1, 3 and 5 are journalled in bearing blocks supported by the frame of the machine, while the upper pressure rollers 2, 4 are supported by movable arms which enable them to be applied against the corresponding lower rollers, in accordance with a conventional design which does not form part of the invention and which has not been shown in the drawings.

Between the pair of feed rollers 1, 2 and the pair of drawing-off rollers 3, 4 are disposed a supplementary roller having needle-like projections 8 and a needled-surface control roller 9, the interval between the axes of which is sufficient in order that their sets of needles do not penetrate one into the other. The control roller 9 is arranged quite close to the lower drawing-off roller 3, while the feed roller 8 is located upstream relative to the needled-surface control roller, considered in the direction of progress of the staple 10 in the course of drawing out the staple. These needled rollers are likewise supported by shafts which are journalled in bearing blocks fixed to the frame of the machine.

Above the course of the lap of staple 10 to be drawn off are arranged a supplementary needled-surface roller 12 and a levelling-down or compacting roller 13 likewise carried by the aforesaid movable arms.

Figure 3:
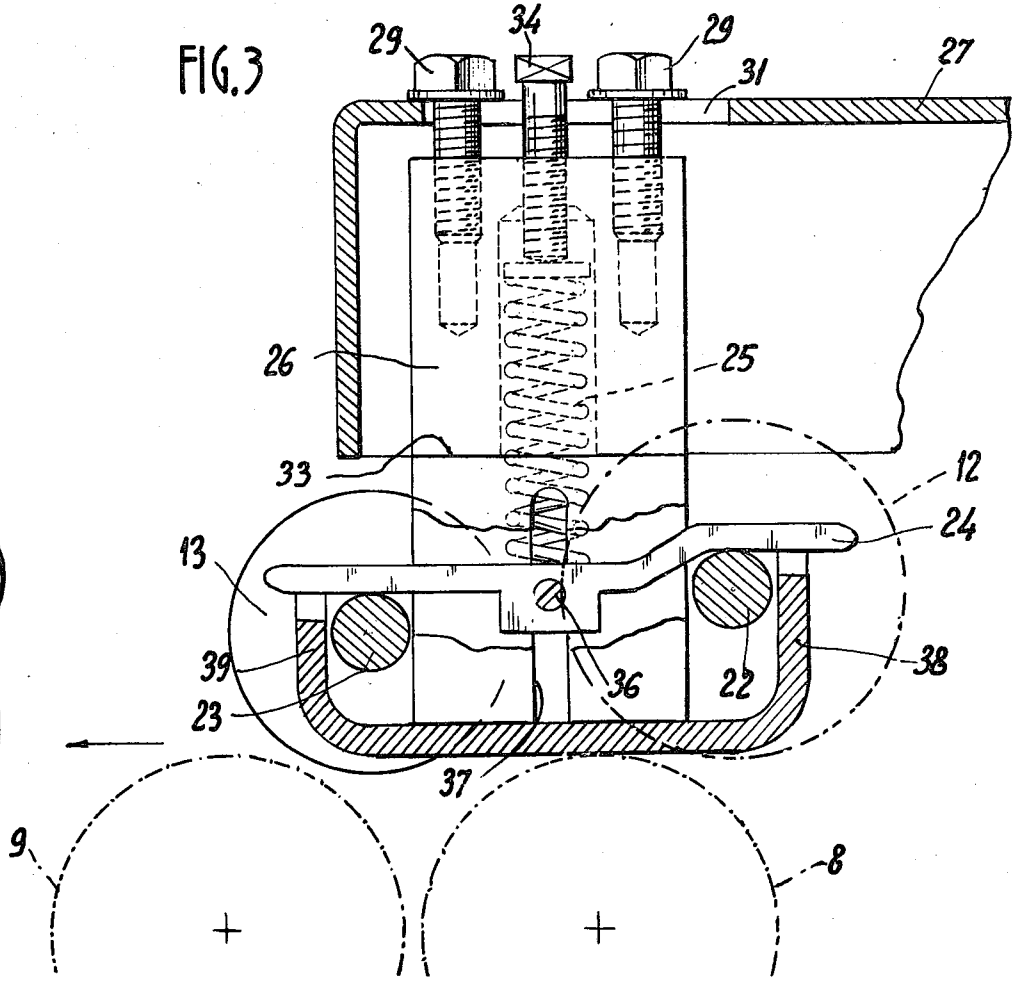
FIG. 3 shows, likewise in section, one way in which the shafts of the supplementary serrated roller and the levelling roller may be mounted on a movable arm.

In FIG. 3 there is shown one manner of mounting in which the ends of the shafts 22, 23 of the supplementary roller 12 and of the levelling-down roller 13, respectively, are urged downwards by a latch-plate 24 which slides, urged by a spring 25, between the limbs of a yoke formed at the lower part of a block 26 fixed in a movable arm 27 of inverted U-section by means of screws 29 which extend through an elongate slot in said arm. The block 26 has two lateral shoulders 33 which bear against the lower faces of the arm 27. The spring 25 bears against the upper face of the latch-plate 24 and is supported against the end of a regulating screw 34 mounted in the upper part of the block 26. A horizontal gudgeon 36 fixed in the latch-plate 24 slides in slots 37 in the yoke and guides said latch plate. The shaft 22, 23 are retained between the lateral faces of the yoke and two upright feet 38, 39 integral with the end of the yoke.

The distance between the shafts of the supplementary roller 12 and of the levelling-down roller 13 is constant. Through displacement of the block 26 along the arm 27, it is possible to modify the extent to which the levelling-down roller 13 is lowered, the latter and the upper needled-surface roller remaining tangential, respectively, to the needled-surface control and feed rollers 9 and 8.

The means hereinbefore described enables regulation of the value of the distance *e* (FIG. 1) which separates the supplementary roller 12 and the feed roller 8 in terms of the thickness of the lap of staple to be drawn out and the nature of the staple of which the lap is constituted, preferably between values of the order of 1 to 4 mm.

The diameter of the supplementary roller with needle-like projections is substantially equal to the diameter of the feed roller and its axis is displaced rearwardly, in relation to the direction of progress of the lap of staple 10, by a distance at least equal to a quarter of its own diameter.

The axis of the levelling-down roller 13 is situated upstream with respect to the axis of the control roller 9 and the geometrical plane which is tangent both to the levelling-down roller 13 and to the drawing-off roller 3, 4 cuts the cylindrical surface of the control roller 9 to a depth of between 0.5 and 10 mm. from the tips of the needles, so as to determine the depth with which the lap of staple is sunk into the set of needles of the control roller 9.

The ratio of the peripheral speeds of the supplementary upper roller 12 and of the feed roller 8 has a value perceptibly included between 0.9 and 1.10. This result is obtained, for example, by causing the two rollers to rotate at the same speed and given them slightly different diameters, or alternatively by driving the two rollers by means of appropriate gearing systems capable of impressing thereon the required angular velocities, taking into account the respective external diameters of the two rollers.

Figure 2:
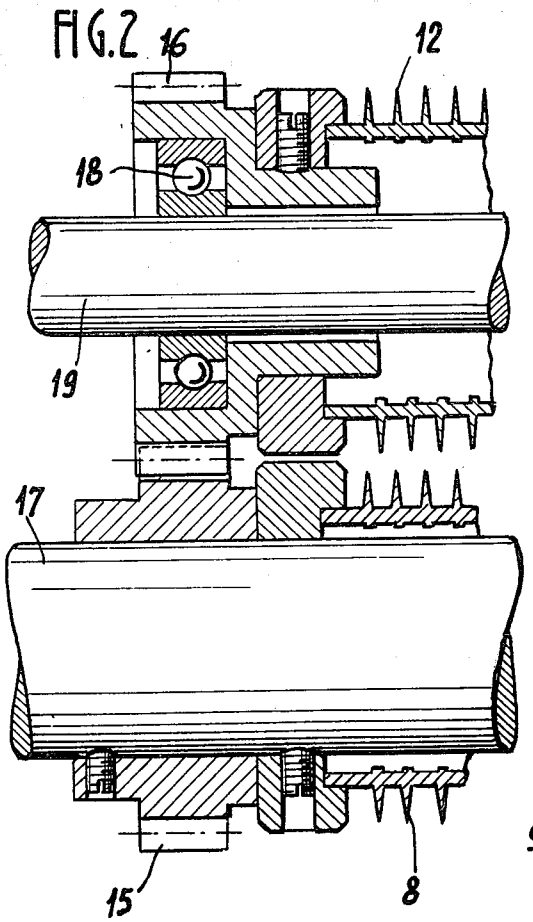
FIG. 2 is a partial section along the line II—II of FIG. 1.

In FIG. 2 there is shown the manner in which the supplementary roller 12 is rotated from the feed roller 8 by a transmission which comprises two gearwheels 15, 16 of the same diameter in mesh with one another, the first being integrated with a shaft 17 on which the feed roller 8 is secured and the second being integrated with the supplementary roller 12 mounted idly by ball bearings such as 18 on a fixed shaft 19.

The device operates in the following manner:

The staple 10 which is progressed by the feed rollers 1, 2 first of all passes between needled-surface feed roller 8 and the supplementary needled-surface roller 12, then between the control roller 9 and the levelling-down roller 13 (each having needle-like projections), to be seized and drawn off by the two drawing-off rollers 3, 4 augmented by the delivery or discharge roller 5. The two sets of needles which are parts of the feed roller 8 and the supplementary roller 12, respectively, control the lap of staple 10 throughout its thickness, since the spacing between these two rollers (and their needle tips) can be adjusted. The levelling-down roller 13 rotates at much the same speed as the control roller 9 since it is carried along only by the staple in contact with the latter needled roller, which is a circumstance favourable to good drawing out. The levelling roller could just as well be positively driven at an angular velocity such that its peripheral speed is equal to that of the control roller. To this end, the levelling-down roller carries, for example, at its two ends and outside of the working zone, two cheeks in contact, respectively, under the action of a spring, with two other interacting cheeks carried by the control roller. Moreover, through the adjustment of the position in height of the levelling-down roller 13, there is adjusted the value of the depth *f* which determines the extent to which the staple lap is pressed into the set of fallers of the control roller 9.

It will be understood that the invention is not restricted to the embodiment thereof described and shown, and may be modified in many ways open to the specialist in the art, in accordance with the applications in prospect, without thereby departing from the scope of the invention as defined in the claims.

I claim:

1. A device for drawing textile fibers, comprising a pair of feed rollers and a pair of drawing rollers said pairs determining therebetween the course of a staple lap to be drafted; a toothed feed roller and a toothed control roller at one side of said course; a supplementary toothed roller and a single levelling-down roller at the other side of said course; said supplementary toothed roller being situated rearwardly of said toothed feed roller in relation to the direction of progress of a staple lap through said device, and being positioned to form a nip solely with said toothed feed roller; said single leveling-down roller being smooth surfaced and positioned a short distance upstream relative to said toothed control roller in relation to the direction of progress of a staple lap through said device while forming a nip solely with said toothed control roller.

2. A device for drawing textile fibers as claimed in claim 1, wherein a geometrical plane tangent both to said levelling-down roller and to said drawing rollers cuts the outer cylindrical surface of said toothed control roller to a depth between 0.5 and 10 mm.

3. A device for drawing textile fibers as claimed in claim 1 wherein said supplementary toothed roller is situated rearwardly of said toothed feed roller a distance at least equal to one quarter the diameter of said supplemental toothed roller.

* * * * *

UNITED STATES PATENT AND TRADEMARK OFFICE

CERTIFICATE OF CORRECTION

PATENT NO. : 3,942,223

DATED : March 9, 1976

INVENTOR(S) : Roger Gauvain

It is certified that error appears in the above-identified patent and that said Letters Patent are hereby corrected as shown below:

[75] Inventor:

ROGER GAUVAIN

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*